US006715755B2

(12) United States Patent
Sussmeier

(10) Patent No.: US 6,715,755 B2
(45) Date of Patent: Apr. 6, 2004

(54) DETERMINISTIC ALIGNER FOR AN OUTPUT INSERTER SYSTEM

(75) Inventor: John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/981,959

(22) Filed: Oct. 18, 2001

(65) Prior Publication Data

US 2003/0075861 A1 Apr. 24, 2003

(51) Int. Cl.[7] ..... B65H 9/16
(52) U.S. Cl. ..... 271/251
(58) Field of Search ..... 271/250, 251

(56) References Cited

U.S. PATENT DOCUMENTS

| | | | | | |
|---|---|---|---|---|---|
| 4,111,412 | A | * | 9/1978 | Cathers | 271/251 |
| 4,527,792 | A | | 7/1985 | Burkhardt | 271/225 |
| 4,995,504 | A | * | 2/1991 | Kuhn | 198/408 |
| 5,048,817 | A | * | 9/1991 | Roller | 271/250 |
| 5,180,154 | A | | 1/1993 | Malick | 271/2 |
| 5,180,159 | A | | 1/1993 | Malick | 271/302 |
| 5,188,355 | A | | 2/1993 | Lowell et al. | 271/225 |
| 5,318,285 | A | | 6/1994 | Edwards et al. | 271/225 |
| 5,413,326 | A | | 5/1995 | Wright | 271/225 |
| 5,538,239 | A | | 7/1996 | Auerbach et al. | 271/225 |
| 5,538,241 | A | | 7/1996 | Auerbach et al. | 271/274 |
| 5,575,465 | A | | 11/1996 | Auerbach et al. | 271/9.13 |
| 5,667,214 | A | | 9/1997 | Belec et al. | 271/251 |
| 6,102,391 | A | | 8/2000 | Malick et al. | 271/225 |
| 6,146,643 | A | * | 11/2000 | Tsarev et al. | 424/226.1 |

* cited by examiner

*Primary Examiner*—Christopher P. Ellis
*Assistant Examiner*—Mark A. Deuble
(74) *Attorney, Agent, or Firm*—Michael J. Cummings; Charles R. Malandra, Jr.; Angelo N. Chaclas

(57) ABSTRACT

A system and method for performing a right angle transfer and for aligning stuffed envelopes in a high speed mail processing inserter system, whereby unwanted timing variation in the aligning process is lessened by using a moving vertical aligning belt as the aligning wall against which envelopes are impacted and aligned.

8 Claims, 3 Drawing Sheets

DETERMINISTIC ALIGNER FOR AN OUTPUT INSERTER SYSTEM

TECHNICAL FIELD

The present invention relates to an aligning module in a high speed mass mail processing and inserting system. The aligning module ensures that the edges of envelopes, or other articles, in the output subsystem are consistently registered along a plane parallel to a transport direction. Proper registration helps to ensure that an envelope is properly aligned for future processing of the envelope, such as for performing a sealing operation, or for applying postage indicia.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Additional, other organizations, such as direct mailers, use inserts for producing a large volume of generic mailings where the contents of each mail item are substantially identical for each addressee. Examples of such inserter systems are the 8 series and 9 series inserter systems available from Pitney Bowes Inc. of Stamford Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

An inserter system may typically include a right angle transfer module to perform a 90-degree change of direction of documents flowing through the inserter system. The right angle transfer module allows for different configurations of modules in an inserter system and provides flexibility in designing a system footprint to fit a floor plan. Such a right angle transfer module is typically located after the envelope-stuffing module, and before the final output modules. Right angle transfer modules are well known in the art, and may take many different forms.

During processing, envelopes will preferably remain a regulated distance from each other as they a transported through the system. Also, envelopes typically lie horizontally, with their edges perpendicular and parallel to the transport path, and have a uniform position relative to the sides of the transport path during processing. Predictable positioning of envelopes helps the processing modules perform their respective functions. For example, if an envelope enters a postage-printing module crooked, it is less likely that a proper postage mark will be printed. For these reasons it is important to ensure that envelopes do not lie askew on the transport path, or at varying distances from the sides of the transport path.

For this purpose, envelopes, or other documents, are typically urged against an aligning wall along the transport path so that an edge of the envelope will register against the aligning wall thereby straightening the envelope and putting it at a uniform position relative to the sides of the transport path. This aligning function may be incorporated into a right angle transfer module, whereby a document may impact against an aligning wall as part of performing a 90-degree change of direction.

Typically the envelope edge that is urged against the aligning wall is the bottom edge, opposite from the top flapped edge of the envelope. Thus after coming into contact with the aligning wall and being "squared up," the envelope travels along the transport path with the left or right edge of the envelope as the leading edge.

The action of impacting the bottom edge of the envelope against the aligning wall may also serve the purpose of settling the stuffed collation of documents towards the bottom of the envelope. By settling the collation to the bottom of the envelope it is more likely that no documents will protrude above the top edge of the envelope, and that the envelope flap can be closed and sealed successfully.

Current mail processing machines are often required to process up to 18,000 pieces of mail an hour. Such a high processing speed may require envelopes in an output subsystem to have a velocity as fast as 85 inches per second (ips) for processing. At such a high rate of speed, system modules, such as those for sealing envelopes and putting postage on envelopes, have very little time in which to perform their functions. If spacing is not maintained between envelopes the modules may not have time to perform their functions, envelopes may overlap, and jams and other errors may occur.

For example, if the space between contiguous envelopes has been shortened, a subsequent envelope may arrive at the postage metering device before the meter has had time to reset, or perhaps even before the previous envelope has left. As a result, the meter will not be able to perform its function on the subsequent envelope before a subsequent envelope arrives. As a result, the whole system may be forced to a halt. At such high speeds there is very little tolerance for variation in the spacing between envelopes.

Other potential problems resulting from excess variation in distance between envelopes include decreased reliability in diverting mechanisms used to divert misprocessed mail pieces, and decreased reliability in the output stacking device. Each of these devices have a minimum allowable distance between envelopes that may not be met when unwanted variation occurs while envelopes travel at 85 ips.

Jam detection within the aligning module itself may become difficult to manage. Jam detection is based on theoretical envelope arrival and departure times detected by tracking sensors along the envelope path. Variability in the aligner module will force the introduction of wide margins of error in the tracking algorithm, particularly for start and stop transport conditions, making jam detection less reliable for this module.

The conventional aligner system described above presents a problem for such a high-speed system because it inherently introduces undesirable variation that can contribute to a failure. As envelopes in a high speed mailing system impact the conventional aligner wall, the impact causes the envelopes to decelerate in a manner that may cause the gap between envelopes to vary as much as +/−30 ms. While such a variation might not be significant in slower machines, this variation can be too much for the close tolerances in current high speed inserter machines.

SUMMARY OF THE INVENTION

The present invention addresses the problems of the conventional art by providing a deterministic aligner. The aligner is incorporated into a right angle transfer module, whereby an envelope (or other document) to be aligned impacts with an aligner wall during a 90 degree change in direction. A deterministic aligner avoids the uncontrollable variation in envelope position inherent in conventional aligners. Such a deterministic aligner is characterized by having an aligner wall that comprises a vertical moving belt against which envelopes impact. Such an aligner belt preferably moves at the same speed and in the same direction as the desired down stream flow path for the envelopes. It has been found that the impact of an envelope with an aligner wall comprising a moving vertical aligner belt does not cause the same non-deterministic behavior that was undesirable in conventional aligners.

DETAILED DESCRIPTION

Figure 1:
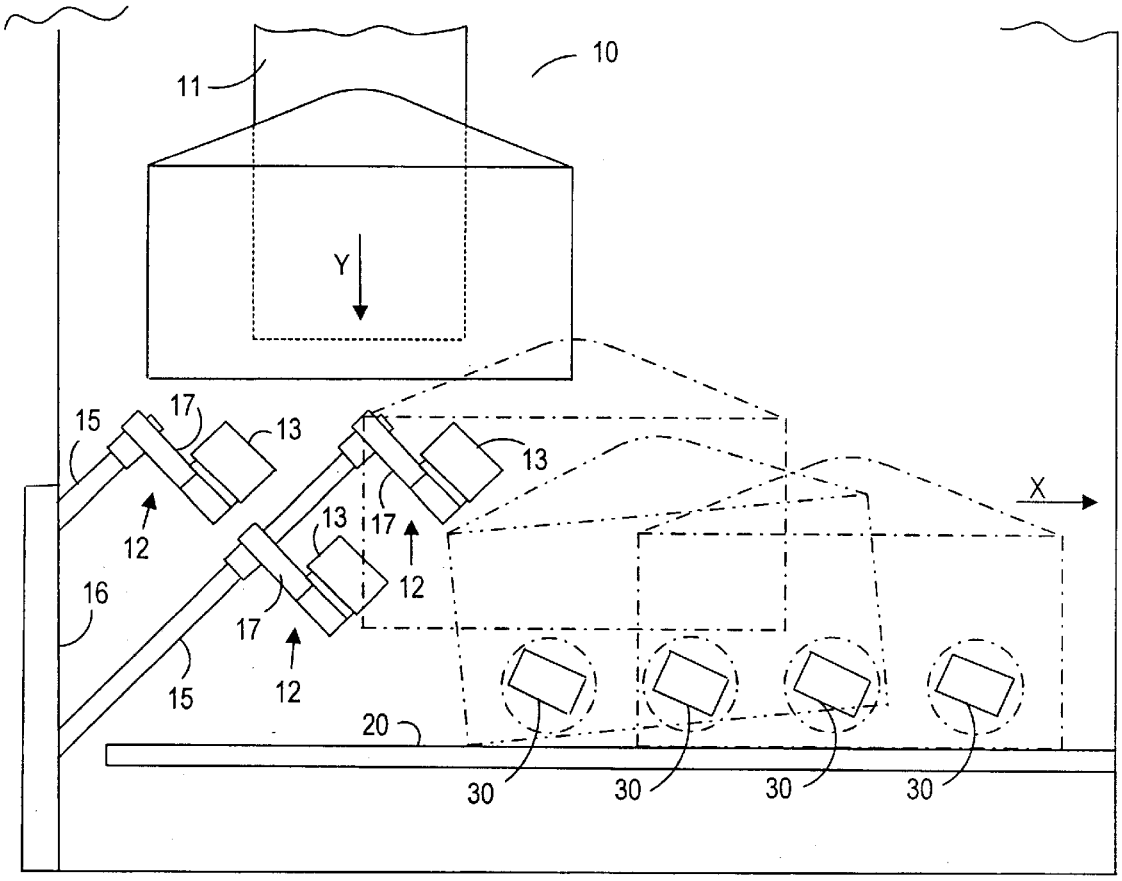
FIG.1 ( PRIOR ART )
FIG. 1 is a top view of a non-deterministic aligner system.

FIG. 1 depicts a non-deterministic aligner system that does not utilize the aligner belt 40 (FIG. 2) of the preferred embodiment of the invention. FIG. 1 will be used to illustrate the disadvantages of not using an aligner belt as part of the registration wall.

Transported envelopes are introduced into the aligner system at an input section 10. Input section 10 may typically include a belt 11 on which envelopes are carried from a prior module into the aligner system. Initially the envelopes travel in the direction designated "Y," toward aligner wall 20.

Figure 3:
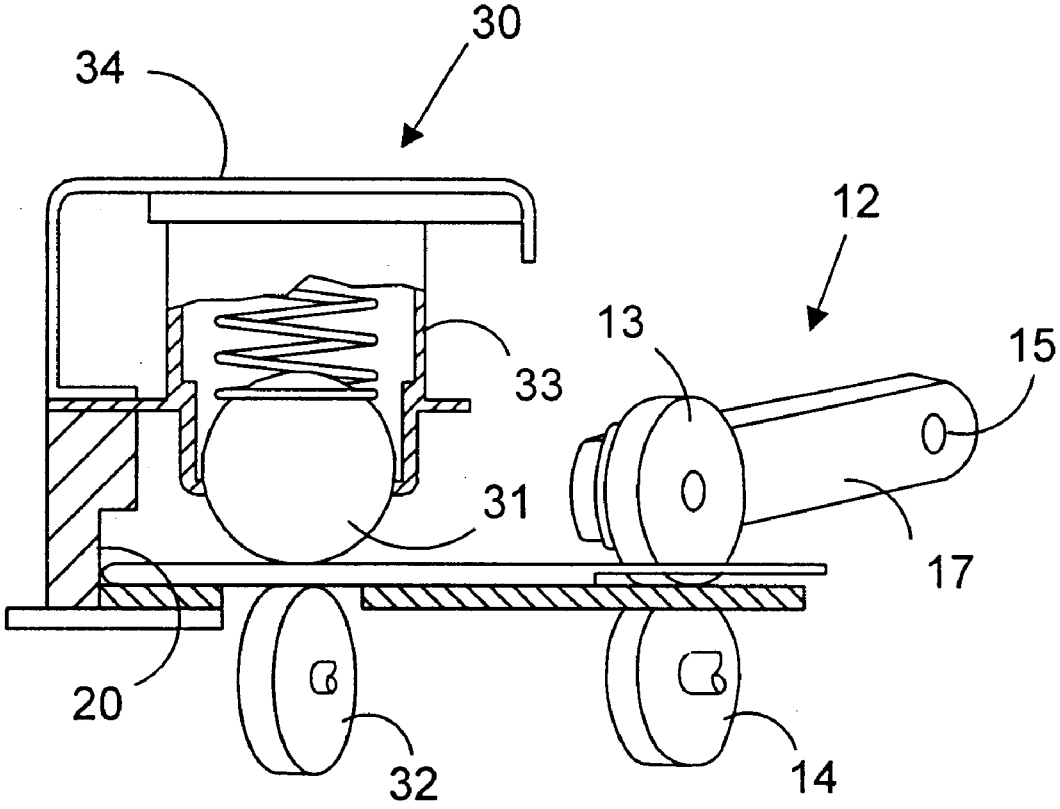
FIG. 3 is a view of rollers used in the aligner system.

From belt 11, a transported envelope will be captured by a redirecting transport which, for example, may be comprised of three roller pairs 12. The redirecting transport changes the direction of transport by 45 degrees in the "X" direction. As seen in FIG. 3, each of roller pairs 12 are "hard-nipped" and include an upper biased idler roller 13 and a corresponding lower driven roller 14. A normal force is applied by the upper biased rollers 13 which are coupled to a supporting shaft 15 extending from a mounting plate 16. Each idler roller 13 is rotatably mounted on a pivotal lever arm 17. A torsion spring is mounted on each shaft 15 and is attached at one end to shaft 15 and at the other end to lever arm 17 so as to bias each idler roller 13 downward against the corresponding lower driven rollers 14.

After having its direction changed by 45 degrees by the redirecting transport, a transported envelope travels to registration wall 20 and aligner rollers 30, as depicted in FIG. 1. Upon impact with the registration wall 20, the envelope can no longer travel in the Y direction. Aligner rollers 30, working in conjunction with registration wall 20, cause a transported envelope to travel in the output path direction (designated "X" in FIGS. 1 and 2), while at the same time being urged firmly against the registration wall. Aligner rollers 30 are oriented at an angle of 25 degrees relative to the X direction to drive transported envelopes in the flow direction X and against the registration wall.

As can be seen in FIG. 3, aligner rollers 30 are "soft-nipped" and each include a roller pair having an upper biased idler roller 31 and a corresponding lower driven roller 32. The lower driven rollers 32 are angled at twenty-five degrees from transport direction X, and drive in both the X direction and in the Y direction, towards the registration wall 20. Preferably each idler roller 31 has a spherical configuration and extends partially downward through a circumferential opening formed in a housing 33. Each housing 33 extends downward from a mounting plate 34. Within each housing is a spring 35 that is biased between the top surface portion of the spherical roller 31 and the top wall of mounting plate 34 so as to provide the normal force against the corresponding lower driven roller 32. One of skill in the art will recognize that the arrangement of aligner rollers 30 depicted in the Figures is but one example from a range of aligner transports that may be used in connection with the present invention.

In operation, in order to meet the speed requirements of modern inserter systems, stuffed envelopes are transported and processed through the system at 85 inches per second (ips). Thus, when an envelope initially enters the input section 10 of the aligner system it is traveling at 85 ips in the Y direction. For further processing, it is desired that the envelope do a right angle turn as depicted in FIG. 1 and end up traveling in the X direction at 85 ips, with as little variable acceleration and deceleration as possible in between.

To achieve this result, roller pairs 12 in the redirecting transport have a surface speed having velocity vectors of 85 ips in both the X direction and in the Y direction. Accordingly, the combined velocity vector of roller pairs 12 is 120 ips at their 45-degree angle. Therefore, an envelope captured by the hard-nipped roller pairs 12 undergoes acceleration in the X direction to 85 ips while continuing in the Y direction at 85 ips.

When the envelope reaches aligner rollers 30, it is desirable to maintain the envelope's velocity vector of 85 ips in the X direction. Taking into account the 25-degree angle of the rollers towards the Y direction, the surface velocity of aligner rollers 30 is 94 ips (X: 85 ips, Y: 40 ips). The velocity vector of aligner rollers 30 in the Y direction urges the envelopes against the registration wall and achieves alignment of the envelopes.

Ideally, the 85 ips transport velocity in the X direction achieved by the hard-nipped rollers 12 is maintained by the soft nipped rollers 30, and even spacing between subsequent envelopes is maintained. However, it has been observed that upon the impact of an envelope with the registration wall 20 the reactionary force of the registration wall 20 decelerates the envelope in a non-deterministic manner that can disrupt the spacing between envelopes.

The reactionary force will include a component opposite the X-direction. This force will depend on the normal force between the registration wall 20 and the envelope and the coefficient of friction ($\mu$) between the envelope and the wall 20. The reactionary force in the X direction, $R_X$, is the product of the coefficient of friction, $\mu$, and the normal force of the aligner wall on the envelope in the Y direction, $R_y$. In equation form, the force balance is: $R_x=\mu R_y$.

The deceleration of an envelope resulting from the impact will also depend on the positioning of the envelope, the angle of the impact, and the coefficient of restitution. For example, an envelope could impact the wall with its bottom edge, or instead, the leading or trailing corner could impact first. Each of these uncontrollable varying circumstances could result in different reactionary forces being exerted on the envelope opposite the X direction. As a result of the varying reactionary forces from the impact of the envelopes with the registration wall 20, the spacing between envelopes can vary as much as +/−30 ms.

Figure 2:
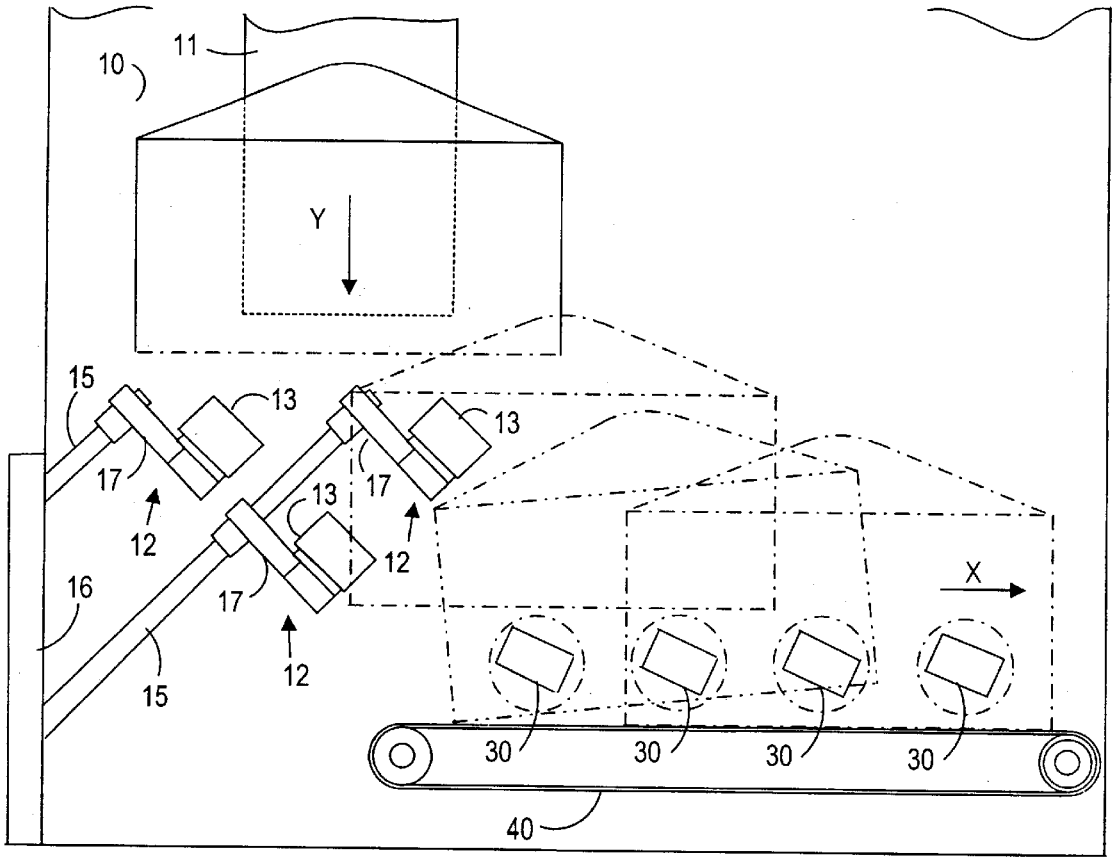
FIG. 2 is a top view of a deterministic aligner system using an aligner belt.

With reference to FIG. 2, registration wall 20 can comprise a high coefficient of friction vertical aligner belt 40 to eliminate such unwanted variation in impact reactionary forces. Aligner belt 40 moves at the desired speed of the envelope in the X direction, e.g. at 85 ips for the example above. Because the aligner belt 40 is moving at the same speed as the envelope in the X direction, there is no reactionary force relative to the X direction resulting from the impact of the envelope with the belt. Even if one of the envelope corners first impacts the aligner belt 40, the resulting translation of the envelope in the X direction is constant. The component of the aligner rollers 30 in the Y direction will continue to urge the envelope to register its bottom edge against the aligner belt 40 as the registration wall.

Aligner belt 40 is preferably made from a rubber material having a high coefficient of friction, preferably greater than 1. The aligner belt 40 is thicker than a typical timing belt to help absorb the energy of impact of the envelope, thereby reducing the likelihood of bounce and promoting consistent translation in the X direction. In this preferred embodiment, the rubber belt is approximately ⅛ inch thick, but may vary in a range from 1/16 to ¼ inch thick.

In the preferred embodiment, the aligner belt 40 is electronically geared to the aligning rollers 30 to provide consistent translation during starting and stopping conditions. The aligner belt 40 may be physically geared to the aligning rollers 30, or they may be controlled in a manner so as to accelerate and decelerate at the same rate when starting and stopping.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An aligner for aligning and maintaining regular spacing of envelopes traveling in a mail processing system comprising:

an aligner wall comprising a vertical aligner surface of a vertical aligner belt, the vertical aligner belt rotating such that the vertical aligner surface is moving in an output flow direction at a belt velocity;

an aligner transport disposed next to the aligner surface of the aligner belt, the aligner transport having a transport velocity component in the output flow direction and a normal velocity component normal to the aligner surface, whereby an envelope placed on the aligner transport is simultaneously transported in the output flow direction and urged against the aligner surface;

an input transport inputting envelopes at regular intervals in an input direction, the input direction being different than the output flow direction; and a redirecting transport receiving envelopes from the input transport and redirecting them in a direction between the input direction and the output flow direction, the redirecting transport providing envelopes to the aligner wall and aligner transport, the redirecting transport having a velocity component in the output flow direction equal to the transport velocity component of the aligner transport; and wherein the belt velocity is equal to the transport velocity component whereby a reactionary force from an impact of envelopes against the aligner wall in performing a change is minimized.

2. The aligner of claim 1 wherein the aligner transport comprises a plurality of aligner rollers angled at substantially 25 degrees from parallel to the output transport direction.

3. The aligner of claim 1 wherein the surface of the vertical aligner belt has a coefficient of friction greater than unity.

4. The aligner of claim 1 wherein the vertical aligner belt is sufficiently thick that an impacting envelope will not bounce.

5. The aligner of claim 4 wherein the vertical aligner belt is approximately ⅛inch thick.

6. The aligner of claim 1 wherein the redirecting transport comprises a plurality of redirecting rollers and the aligner transport comprises a plurality of aligner rollers and a transition from the redirecting transport to the plurality of aligner rollers occurs at a first aligner roller, and the first aligner roller is positioned relative to the plurality of redirecting rollers so that the first aligner roller first contacts individual envelopes at the middle or downstream of the middle of the envelopes.

7. The aligner of claim 6 wherein the plurality of aligner rollers are angled at substantially 25 degrees from parallel to the output transport direction and the plurality of redirecting rollers are angled at substantially 45 degrees from parallel to the output transport direction.

8. The aligner of claim 6 wherein the plurality of redirecting rollers are hard-nipped rollers and the plurality of aligner rollers are soft-nipped rollers.

* * * * *